US005720666A

United States Patent [19]

Arculeo

[11] Patent Number: 5,720,666

[45] Date of Patent: Feb. 24, 1998

[54] LIGHTWEIGHT MARBLE COMPOSITE ARTICLE AND METHOD OF CONSTRUCTION FOR TABLE SURFACES AND SIDE RAILS INCLUDING POOL AND GAMING TABLES

[76] Inventor: Anthony Arculeo, 5614 Forrest St., Hollywood, Fla. 33021

[21] Appl. No.: 779,282

[22] Filed: Jan. 22, 1997

[51] Int. Cl.[6] ..... A63D 15/06

[52] U.S. Cl. ..... 473/31

[58] Field of Search ..... 473/31, 32

[56] References Cited

U.S. PATENT DOCUMENTS

| | | | |
|---|---|---|---|
| 1,158,793 | 11/1915 | Drouot | 473/31 |
| 1,323,516 | 12/1919 | Acland | 473/32 |
| 3,466,035 | 9/1969 | Duarte | 473/31 |
| 3,811,673 | 5/1974 | Baker | 473/31 |

*Primary Examiner*—William M. Pierce

*Attorney, Agent, or Firm*—Malin, Haley, DiMaggio & Crosby, P.A.

[57] ABSTRACT

The invention relates to a table surface and side rail, including a replacement table surface or rail, and construction method, wherein the surface or side rail can have nearly any desired appearance, one example being marble, but that is light in weight and does not buckle or separate after construction. The table rail is made using a sandwiched construction method. In one embodiment, an under piece or under layer is provided, which may be a wood under piece, a relatively thin exterior surface layer is also provided, and is made of a suitable material to give a desired appearance, such as marble. A middle or interior layer is sandwiched between the under layer and the exterior layer. The middle layer is made of a gypsum board that does not absorb water and provides a buffer between the under and exterior layers. The sandwich is bonded together using a polyester resin. The exterior is polished to a high quality seamless fine finish of nearly any desired appearance, such as marble, and is then installed in new construction or reinstalled as a replacement or retrofit.

17 Claims, 2 Drawing Sheets

LIGHTWEIGHT MARBLE COMPOSITE ARTICLE AND METHOD OF CONSTRUCTION FOR TABLE SURFACES AND SIDE RAILS INCLUDING POOL AND GAMING TABLES

BACKGROUND OF THE INVENTION

1. Field of the Invention

This invention relates generally to table surfaces and side rails, and more particularly to table surfaces and side rails, including replacement rails, and method of construction, for pool and billiard tables, gaming tables, and other tables and the like, where the surface and rails can have any decorative appearance desired, including marble, and be light in weight.

2. Description of Related Art

The manufacture or fabrication of furniture from material such as marble is well known in the art and produces furniture with an elegant and desirable finish. However, the use of material such as marble in combination with gaming tables such as billiards and pool tables, and roulette, blackjack, and other card tables, has not been utilized previously in view of the weight considerations of marble.

For example, billiard and pool tables are generally rectangular tables that and include perimeter rails which join at right angles, and which, in the case of pool tables, are interrupted by pockets at the corners and along the longer sides. The playing surface of pool tables is usually a thick piece of slate, which is shaped nearly perfectly flat prior to use. The slate is very heavy and must be supported by a carrying surface because the slate cannot support its own weight. The table itself must be manufactured and leveled with extreme accuracy for a proper playing surface.

The perimeter rails of the table are usually made of wood, and support the resilient cushion or bumper that is generally covered by a felt fabric, and that rebounds the game balls. The weight of a table having the preferable slate playing surface and wooden rails is already very heavy making movement and leveling of the table difficult. The support legs of such slate pool tables cannot be made to support much additional weight and still provide a stable platform capable of precise leveling adjustment.

Fabricating the rails of heavy material such as marble, or replacing wood rails of a completed table with rails made of a heavy material such as marble, increases the already heavyweight of the table to unacceptable levels.

Typically in rail construction, wood is used for both the vertical and horizontal sections of the rail. The horizontal section has the cushion or bumper material attached to the edge facing the playing surface. The vertical section is attached to the edge of the horizontal section opposite the bumper material. The horizontal and vertical sections of the rail can be made of hardwood and have a polished wood finish. Alternately, the horizontal and vertical sections can be made of another type of wood, a wood composite, or another material, and can have an exterior veneer with a simulated wood grain finish.

Attempts to replace the wood construction of the rails with other materials, such as marble have been unsuccessful in the past in view of the weight of solid marble. Because the height of the bumper is critical to proper play, the thickness of the material used on the horizontal rail section must be maintained to position the bumper at the correct height. Therefore, the thickness of the material, such as marble has been made to match the thickness of the wood normally used in construction. This makes the rail too heavy for practical application, as mentioned above.

Attempts have also been made to use a thin piece of material, such as marble, to reduce weight, sandwiched over a wood under piece. However, these attempts have had little success because it has been discovered that the placement of a thin piece of the material, such as marble, directly to a wood under piece does not work due to normal expansion and contraction of the wood at a different rate than the attached material. One of the reasons for the expansion and contraction of the wood at a different rate than the surface material, is that wood readily absorbs moisture, whereas the exterior layer material does not absorb moisture. This causes buckling and separation of the sandwiched pieces, especially in a humid environment, such as in the southeastern United States. To date, there has not been a acceptable method of bonding a thin upper material such as marble to the wood under piece without these inherent problems.

Because of the desirable appearance of materials such as marble, there is a need for a lightweight table rail that provides a plurality of desired appearances, especially marble, but does not have the weight penalty of a thick heavy material.

SUMMARY OF THE INVENTION

The present invention relates to a table surface and side rail, including a replacement side rail, and construction method, wherein the surface or side rail can have nearly any desired appearance, one example being marble, but that is light in weight and does not buckle or separate after construction. The present invention accomplishes this by solving the problems existing in the prior art, as discussed above.

The present invention, utilizes, in one embodiment, an under piece or under layer, which may be a wood under piece, and a thin exterior surface layer, made of a suitable material to give a desired appearance, with one embodiment utilizing a relatively thin layer of marble as the exterior layer. Alternately, a thin exterior layer of any other suitable material can be utilized. The wood under piece or under layer and exterior layer sandwiches a third, middle, layer which, in combination, solves many of the problems existing in the prior art.

The third or middle layer, which is sandwiched between the exterior layer and under layer, is made of a suitable gypsum board, such as that disclosed in U.S. Pat. No. 5,220,762, to Lehnert et al., the disclosure of which is incorporated herein by reference. Other material which provide the same characteristics as gypsum board can be utilized and are considered within the scope of the invention. For example, cement board can be substituted for the gypsum board. However, the use of cement board increases the weight. A suitable gypsum board is available from the Georgia-Pacific Corporation under the trademark Dens-Shield®. The Dens-Shield® product is typically used in the building industry as described in U.S. Pat. No. 5,220,762, and is often used as a substrate for the installations, particularly for applications in moist areas such as bathroom tubs and shower areas. The Dens-Shield® substrate provides a moisture and vapor barrier. Dens-Shield® is lightweight, extremely strong, and essentially does not absorb moisture. Due to the unique properties of the Dens-Shield® material, it provides a buffer layer between the wood under layer and the marble exterior layer which prevents the buckling and separation that would occur if the marble is attached directly to the wood under layer.

The layers are bonded together by a polyester resin, with the middle layer of Dens-Shield® essentially completely encapsulated in the resin. The polyester resin dries relatively clear, and is not visible in any seams of the exterior layer that may exist.

Utilizing a sandwiched construction with a gypsum interior or middle layer, as opposed to a full thickness piece of marble over a wood under layer, reduces the weight of a given size of pool table rail, for example, by approximately 50%.

The application of the above sandwiched construction method can be utilized in the construction of any suitable article of manufacture that is desired to have a decorative appearance, but especially where the desired appearance is marble and weight and/or moisture is a factor. The construction can be new construction, or replacement or retrofit of a constructed article. Examples of applications of the invention include side rails for: pool tables, billiard tables, roulette tables, blackjack and card and other tables, entire dinning room tables and coffee tables, alters, and even fireplaces. This list is not intended to be exhaustive, but is intended to illustrate a few specific examples contemplated by the invention.

Accordingly, it is an object of the present invention to provide a pool or other table that appears to be made of solid marble but that is relatively light in weight as compared to a similar sized table made of solid marble.

It is a further object of the present invention to provide a method of constructing a layered article having a marble exterior layer, wood under layer, and moisture barrier central layer, the article appearing to be solid marble but that is light in weight in comparison with a similarly sized article that is solid marble.

In accordance with these and other objects which will become apparent hereinafter, the instant invention will now be described with particular reference to the accompanying drawings.

BRIEF DESCRIPTION OF TEE DRAWINGS

DESCRIPTION OF THE PREFERRED EMBODIMENTS

The present invention will now be described utilizing a replacement pool table side rail as an example of an application of the invention. However, the description is intended to apply to other applications of the invention such as in any gaming table, card table, dining room table, or other article of manufacture utilizing the present invention.

Figures 1, 2, 3, 4:
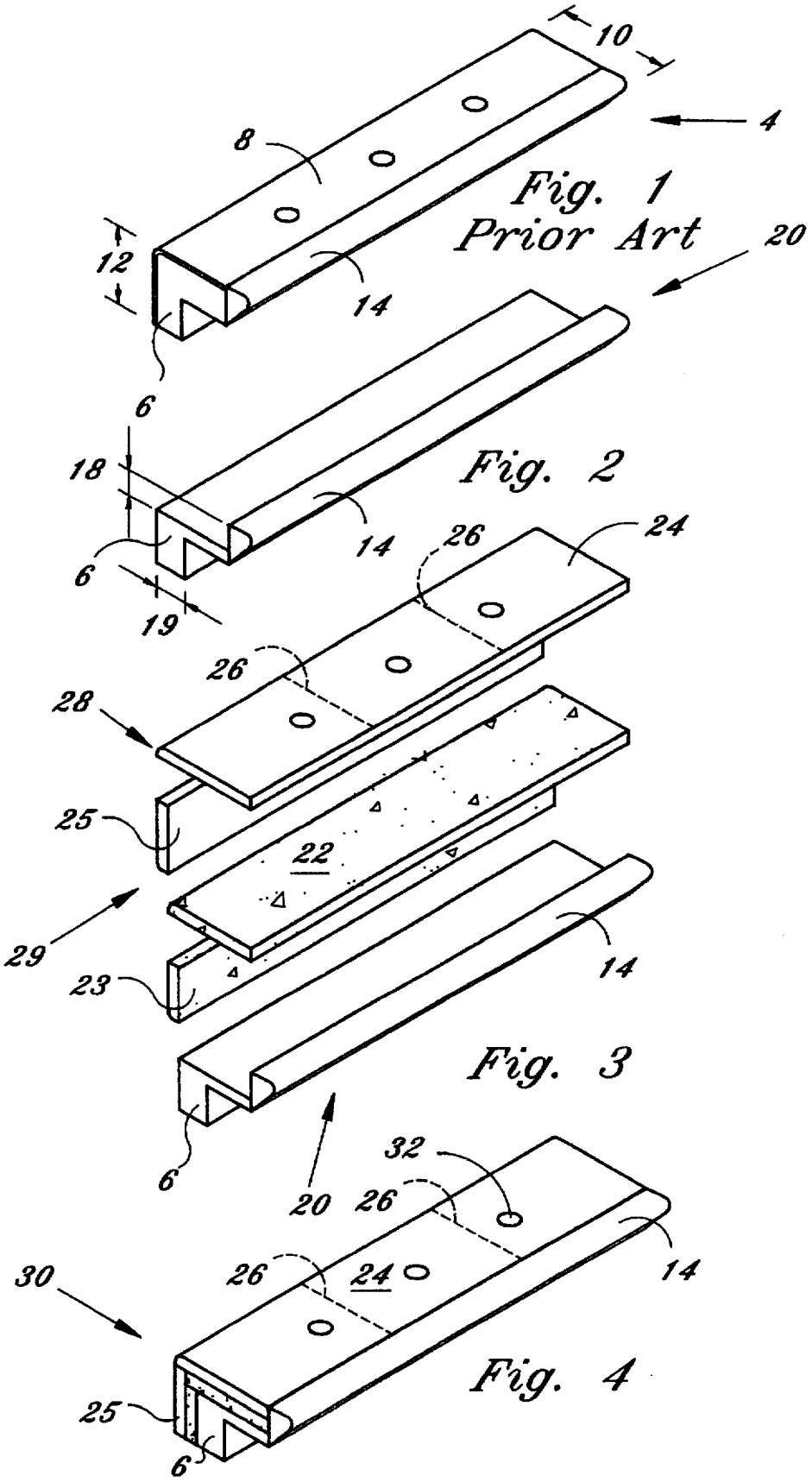
Fig. 1 Prior Art
FIG. 1 is a perspective view of a prior art pool table side rail.
FIG. 2 is a perspective view of the prior art rail of FIG. 1 after preparation of the rail for attachment of the present invention.
FIG. 3 is an exploded perspective view of the present invention for installation on a pool table rail.
FIG. 4 is a perspective view of the present invention installed on a pool table side rail.
Figure 5:
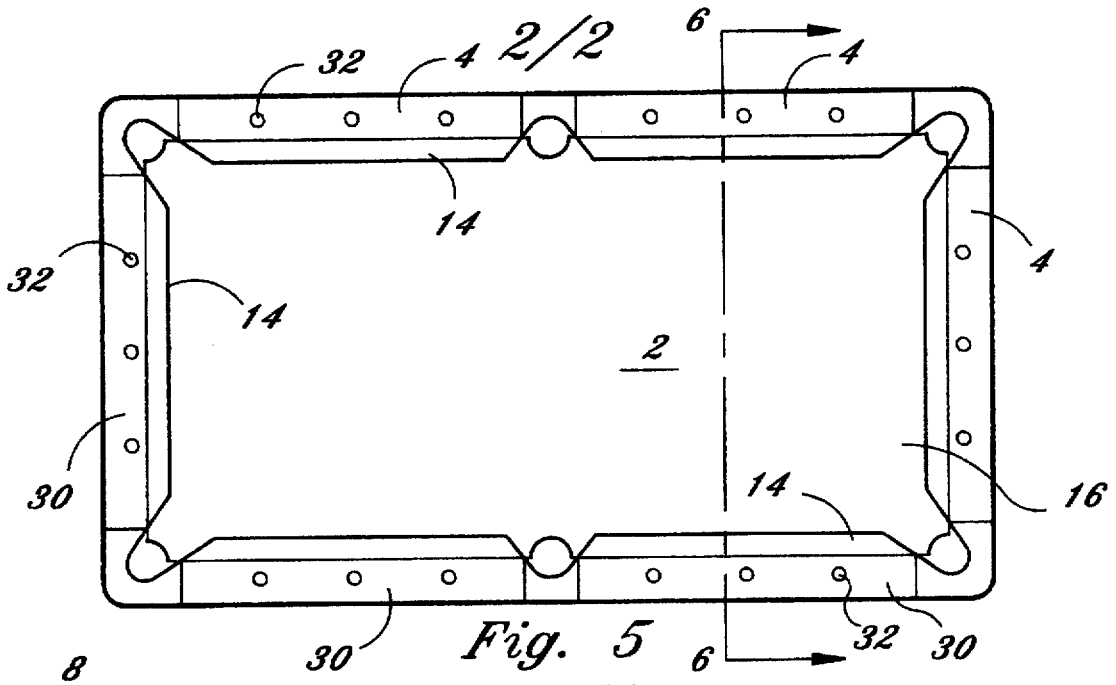
FIG. 5 is a top view of a pool table showing the side rails in place.

Referring now to FIGS. 1 and 5, pool table 2, includes several identical side rails 4. FIG. 5 shows pool table 2 with a portion of its side rails 4, before installation of the present invention, and a portion of its side rails 30, after installation of the present invention, which is fully described herein below.

Figure 6:
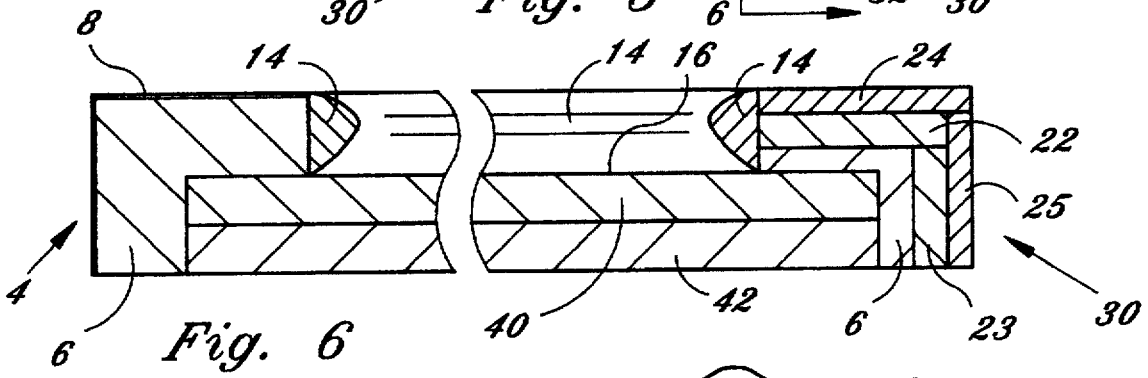
FIG. 6 is a cross-sectional view taken along line 6—6 of FIG. 5.
Figure 7:
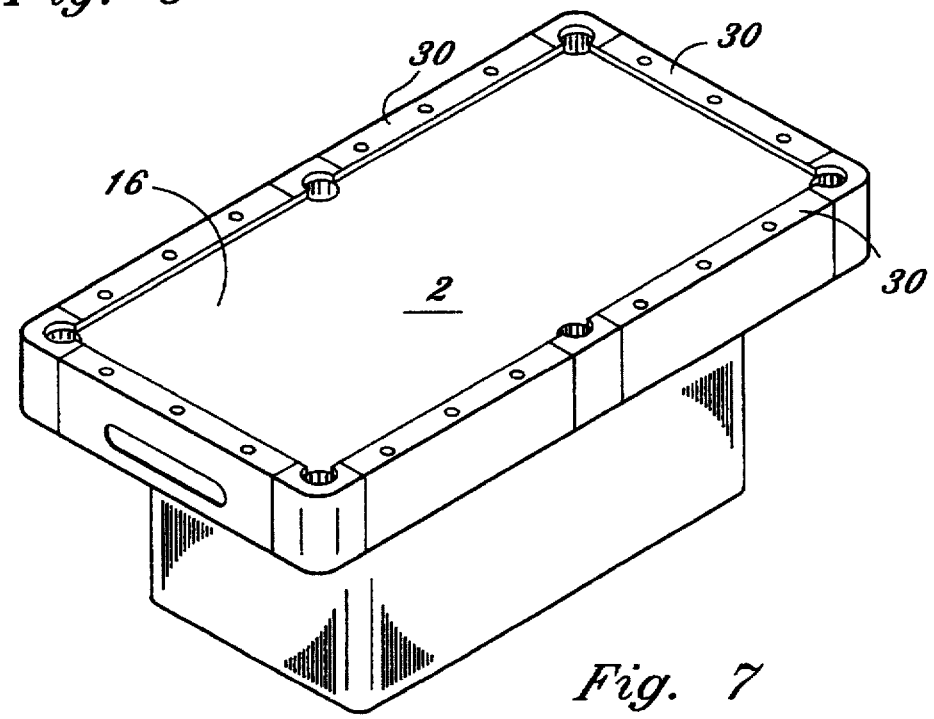
FIG. 7 is a perspective view of the present invention installed on a pool table.

Side rail 4, as shown in FIG. 1, is typically constructed of wooden substrate 6, which may have an exterior veneer 8 on both the horizontal section 10 and the vertical section 12 of the side rail 4. Horizontal section 10, includes resilient cushion or bumper 14 positioned on the edge that faces the interior of table 2. The height of bumper 14 from playing surface 16 of pool table 2, as can be seen in FIG. 6, is critical to proper action of the game. Therefore, the height of bumper 14 must be maintained after the present invention is installed.

In a constructed pool table, rail 4 is first removed from table 2, as depicted in FIG. 1. The horizontal section 10 of substrate 6 must first be reduced in thickness to accommodate the layers that are added with the present invention. This can be done in any suitable manner such as milling through veneer 8 and into substrate 6. As shown in FIG. 2, the bumper 14 of the resultant prepared side rail 20, must be left undamaged. The amount of horizontal portion 10 that must be removed, shown as 18, is approximately equal to the combined thickness of the exterior layer and middle layer that will be installed, as fully discussed herein below, and is in the order of ⅞th of an inch, in one embodiment.

Vertical section 12 may also be reduced in thickness 19, but it is not required, as there is no critical dimension in the thickness 19 of vertical section 12, as there is in horizontal section 10 due to the requirement to meet the height of bumper 14.

Referring now to FIG. 3, the middle layers of gypsum board shown as 22 and 23 are sized and shaped to fit prepared rail 20. As stated herein above, gypsum boards 22 and 23 are preferably Dens-Shield® board supplied by Georgia-Pacific Corporation, and is available in the preferred thickness of ½" (inch), though such thickness dimension is not limiting.

The exterior layers shown as 24 and 25, which can be any suitable material, such as a relatively thin, approximately ⅜" thick, slab of marble. The marble used in exterior layers 24 and 25, can be any standard size slab, such as 12"×12"×⅜" squares cut in any well known manner to fit prepared rail 20. Exterior layers 24 and 25, as shown in FIG. 3 include phantom lines 26 which represent edges of adjacent sized squares of marble. Phantom lines 26 can be in any position on exterior layers 24 and 25, depending on the size of marble used, including nonexisting if one piece of material is used for the entire exterior layers 24 and 25. Edges 28 and 29 of exterior layers 24 and 25 respectively may be shaped and beveled to form a curved appearance.

The middle layers 22 and 23 formed of Dens-Shield® gypsum board, the substrate 6, and the exterior layer 24 are bonded together by a suitable polyester resin which is applied to completely encapsulate board 22 and fill any seams 26 that may exist in exterior layers 24 and 25. The polyester resin chosen should be one that dries essentially clear or transparent, so as not to be seen in any seams 26, that may exist.

Once the resin dries, the exterior surface 24 and 25 is sanded and polished using progressively finer and finer grain size sand paper, until an extremely fine seamless finish is obtained, resulting in the finished side rail 30 having an exterior marble appearance, as shown in FIG. 4.

FIGS. 5 and the right side of FIG. 6 show side rail 30 installed on pool table 2. FIG. 6 shows the height of bumper 14 above the slate playing surface 40. Because slate 40 generally cannot support its own weight, member 42, which can be wood, is shown supporting slate playing surface 40. As can be seen in FIG. 6, the height of bumper 14 on side rail 30 is unchanged in comparison with bumper 14 on the original side rail 4, as shown on the left side of FIG. 6, as is the height of replacement exterior surface 24, versus the original exterior surface 8.

Once the rails are complete, the same process as described above is applied to the legs and the under skirt of the table, if it has one, thus resulting in a table that appears to be made of solid marble, but that is much lighter that a solid marble table. In application of the present invention to surfaces other than the horizontal side rail section, the milling step may not be necessary.

The application of the present invention to a pool table can of course be accomplished during construction of a new table, instead of replacement or retrofit of an existing table. The steps may be somewhat modified for new construction. For example, the substrate 6 may not need to be milled to a thinner dimension, but can be selected initially to the proper thickness. Also, substrate 6 could be a different material other than wood, as long as it is still capable of supporting the added combination of the middle and outer layers.

Furthermore, the application of the present invention to other gaming tables, other tables, or other articles of manufacture can be accomplished by following the same method as described herein above for pool table side rail construction. For example, a dining room table made of thick marble would be extremely heavy. However, a dining room table made according to the present invention will appear as solid marble but will be relatively lightweight, and will not buckle or separate with use. By using the existing table top as the substrate or under layer and layering gypsum board between it and an exterior thin marble layer, a thick marble look alike table, that is much lighter than an actual marble table and which will not separate and buckle with use, can be made.

As stated, the present invention can be utilized on the construction of other articles such as gaming tables for blackjack, poker, roulette, etc., as well as coffee tables, dining room tables, fireplaces, alters, and the like.

Utilizing the present application further provides the ability to add custom detailing during the construction process. For example, the ball spotting marks shown as 32 in FIG. 5 can be shaped stone pieces installed during the installation of exterior layer 24. Likewise, decorative perimeter bands (not shown) can be installed in exterior layer 25 to give custom effects. Virtually any custom appearance can thus be provided.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A pool table side rail for attachment to the perimeter of a pool table comprising:

a first layer shaped and sized as a pool table side rail having an upper exterior edge, said first layer made of a first material;

a second layer sized and shaped for connection to said first layer, said second layer comprising a moisture barrier, said second layer made of second material which is different from said first material;

a third layer sized and shaped for connection to said second layer and to form an exterior surface of said pool table side rail, a portion of said exterior surface being flush with said upper exterior edge; and means for bonding said first layer to said second layer and said second layer to said third layer, said second layer being disposed between said first and said third layers, said first and said third layers being separated apart by said second layer forming said moisture barrier.

2. The device as claimed in claim 1, wherein said first layer is preshaped and sized as a pool table side rail having a resilient bumper connected at a preselected position, said resilient bumper having an upper exterior edge; and wherein said third layer is sized and shaped for connection to said second layer and to form an exterior surface of said pool table side rail, a portion of said exterior surface adjacent to said resilient bumper and flush with said upper exterior edge.

3. The device as claimed in claim 1, wherein said first layer is a wooden substrate.

4. The device as claimed in claim 1, wherein said second layer is made of gypsum board.

5. The device as claimed in claim 1, wherein said third layer is marble, and whereby said side rail appears to be solid marble but is relatively light in weight as compared to a similar sized side rail of solid marble.

6. The device as claimed in claim 1, wherein said means for bonding includes a polyester resin.

7. The pool table side rail of claim 1 wherein said third layer made of a material which is different from said first material and said second material.

8. The pool table side rail of claim 1 wherein said second layer overcomes problems of expansion rates of said first layer and said second layer.

9. A pool table side rail for attachment to the perimeter of a pool table comprising:

a first layer comprising a wood substrate preshaped and sized as a pool table side rail having a resilient bumper connected at a preselected position, said resilient bumper having an upper exterior edge;

a second layer comprising gypsum board sized and shaped for connection to said first layer;

a third layer comprising marble sized and shaped for connection to said second layer and to form an exterior surface of said pool table side rail, a portion of said exterior surface adjacent to said resilient bumper and flush with said upper exterior edge;

means for bonding said first layer to said second layer and said second layer to said third layer, whereby said side rail appears to be a solid piece of marble but is light in weight as compared to a solid marble side rail.

10. The device as claimed in claim 9, wherein said means for bonding includes a polyester resin.

11. A lightweight marble article for use in articles of furniture, gaming tables, and/or decorative items comprising:

a substrate layer made of a first material;

a moisture barrier layer made of a second material which is different from said first material;

a relatively thin marble exterior layer;

means for bonding said substrate layer to said moisture barrier layer, and said moisture barrier layer to said relatively thin marble layer, said substrate layer and said marble layer being separated apart by said moisture barrier layer, whereby the article exterior appears to be a solid piece of marble but is relatively light in weight as compared to a similar sized piece of solid marble.

12. The device as claimed in claim 11, wherein said substrate layer is wooden.

13. The device as claimed in claim 11, wherein said moisture barrier layer is made of gypsum board.

14. The device as claimed in claim 11, wherein said means for bonding includes a polyester resin.

15. A method of constructing a lightweight marble article for use in furniture, gaming tables, and/or decorative items comprising the steps of:

preparing a substrate layer made of a first material to approximately match the size and shape of a desired finished article;

bonding a moisture barrier layer made of a second material which is different from said first material to said substrate layer, said moisture barrier layer sized to cover at least one surface of said substrate layer; and bonding a relatively thin marble layer to said moisture barrier layer, said relatively thin marble layer being separated apart from said substrate layer by said moisture barrier layer.

16. A method of construction as claimed in claim 15, wherein said bonding steps include applying a polyester resin.

17. The method of constructing a lightweight marble article of claim 13 further comprising the step of polishing said relatively thin marble layer to a fine finish, wherein the article exterior appears to be solid marble but is relatively light in weight as compared to a similar sized article of solid marble.

* * * * *